US008837970B2

(12) United States Patent
Seyfried et al.

(10) Patent No.: US 8,837,970 B2
(45) Date of Patent: Sep. 16, 2014

(54) APPARATUS, METHODS, AND SYSTEMS FOR ENGAGING AND DISENGAGING A FIXING NIP FOR CUT SHEET PROCESSING

(75) Inventors: Richard W. Seyfried, Williamson, NY (US); Grace T. Brewington, Fairport, NY (US); Faming Li, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 294 days.

(21) Appl. No.: 13/165,271

(22) Filed: Jun. 21, 2011

(65) Prior Publication Data

US 2012/0328311 A1 Dec. 27, 2012

(51) Int. Cl.
*G03G 15/00* (2006.01)
*G03G 15/20* (2006.01)

(52) U.S. Cl.
CPC ..... *G03G 15/2032* (2013.01)
USPC ..... 399/67; 399/45; 399/68

(58) Field of Classification Search
USPC ..... 399/45, 67, 68, 322, 332
See application file for complete search history.

(56) References Cited

U.S. PATENT DOCUMENTS

| | | | | |
|---|---|---|---|---|
| 7,526,218 | B2 | 4/2009 | Ahl et al. | |
| 2008/0107436 | A1 * | 5/2008 | Mikutsu | 399/67 |
| 2010/0208278 | A1 | 8/2010 | Brewington et al. | |
| 2010/0322667 | A1 * | 12/2010 | Kitagawa | 399/122 |

OTHER PUBLICATIONS

Dale R. Mashtare et al.; U.S. Appl. No. 12/855,011, filed Aug. 12, 2010.
Anthony S. Condello et al.; U.S. Appl. No. 12/855,036, filed Aug. 12, 2010.
Jason M. LeFevre.; U.S. Appl. No. 12/855,054, filed Aug. 12, 2010.
Anthony S. Condello et al.; U.S. Appl. No. 12/855,066, filed Aug. 12, 2010.
Shu Chang et al.; U.S. Appl. No. 12/855,078, filed Aug. 12, 2010.
Grace T. Brewington et al.; U.S. Appl. No. 12/855,106, filed Aug. 12, 2010.
Anthony S. Condello et al.; U.S. Appl. No. 12/978,997, filed Dec. 27, 2010.
Grace T. Brewington et al.; U.S. Appl. No. 13/112,604, filed May 20, 2011.

* cited by examiner

*Primary Examiner* — Walter L Lindsay, Jr.
*Assistant Examiner* — Jessica L Eley
(74) *Attorney, Agent, or Firm* — Ronald E. Prass, Jr.; Prass LLP

(57) ABSTRACT

A fixing device includes a first fixing member a second fixing member that are movable to engage and disengage a fixing nip defined by the first and second fixing member. The fixing nip is disengaged to accommodate entry and exit of a cut sheet, and engaged to accommodate warm-pressure fixing a marking material image to the cut sheet.

17 Claims, 4 Drawing Sheets

APPARATUS, METHODS, AND SYSTEMS FOR ENGAGING AND DISENGAGING A FIXING NIP FOR CUT SHEET PROCESSING

RELATED APPLICATIONS

This application is related to U.S. patent application Ser. No. 13/112,604, entitled "FIXING APPARATUS, SYSTEMS, AND METHODS FOR PRINTING"; U.S. patent application Ser. No. 12/855,011, entitled "MULTI-STAGE FIXING SYSTEMS, PRINTING APPARATUSES AND METHODS OF FIXING MARKING MATERIAL TO SUBSTRATES"; U.S. patent application Ser. No. 12/855,036, entitled "FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB"; U.S. patent application Ser. No. 12/855,054, entitled "FIXING DEVICES INCLUDING LOW-VISCOSITY RELEASE AGENT APPLICATOR SYSTEM AND METHODS OF FIXING MARKING MATERIAL TO SUBSTRATES"; U.S. patent application Ser. No. 12/855,066, entitled "FIXING SYSTEMS INCLUDING CONTACT PRE-HEATER AND METHODS FOR FIXING MARKING MATERIAL TO SUBSTRATES"; U.S. patent application Ser. No. 12/855,078, entitled "FIXING SYSTEMS INCLUDING IMAGE CONDITIONER AND IMAGE PRE-HEATER AND METHODS OF FIXING MARKING MATERIAL TO SUBSTRATES"; U.S. patent application Ser. No. 12/855,106, entitled "FIXING DEVICES INCLUDING EXTENDED-LIFE COMPONENTS AND METHODS OF FIXING MARKING MATERIAL TO SUBSTRATES"; U.S. patent application Ser. No. 12/855,140, entitled "LOW ADHESION COATINGS FOR IMAGE FIXING"; and U.S. patent application Ser. No. 12/978,997, entitled "METHODS, APPARATUS, AND SYSTEMS FOR CONTROLLING GLOSS OF AN IMAGE FIXED BY WARM-PRESSURE FIXING", the entire disclosures of which are incorporated herein by reference in their entirety.

FIELD OF DISCLOSURE

Apparatus, methods, and systems for engaging and disengaging a fixing nip of a printing system are disclosed. More particularly, apparatus, methods, and systems of embodiments relate to disengaging and engaging a nip of a fixing system.

BACKGROUND

In related art printing systems, marking material such as toner is applied to a substrate to form an image. The marking material may be fixed to the substrate by thermal fusing. Thermal fusers such as those used in electrophotographic printing typically operate at high temperatures, e.g., about 150° C. to about 210° C. The energy is used to promote cohesion of toner particles, and promote adhesion of the particles to the substrate. The high temperatures required for thermal fusing may necessitate expensive and cumbersome cooling equipment. Such high temperatures may also limit substrate options, and limit efficiency by, e.g., requiring expensive and time-consuming make-ready and specific parameters per substrate, and requiring short-run times.

SUMMARY

Fixing systems for warm-pressure fixing marking material to a substrate, printing apparatus and systems, and methods of fixing marking material to a substrate address problems associated with thermal fixing. Warm-pressure fixing includes using temperatures at a fixing nip that are significantly reduced from those typically used in thermal fixing processes, and pressures that are significantly increased from those typically used in thermal fusing processes. For example, the nip may be heated to a temperature in a range of about 50° C. to about 120° C. In fixing systems for warm-pressure fixing marking material to a substrate such as a cut sheet, at least one of a first fixing member and the second fixing member are operable to apply pressure to the substrate and toner received at the fixing nip to fix the toner to the substrate. Exemplary pressures to apply at the fixing nip for fixing toner are in a range of about 300 psi to about 1500 psi. For example, a pressure in a range of about 400 psi to 1000 psi, and preferably about 500 psi, may be applied at the nip. Ranges may vary according to a type of marking material used.

It is desirable to incorporate warm-pressure fixing techniques into systems that accommodate cut sheet media printing. More specifically, it is desirable that, e.g., warm-pressure fixing xerographic systems accommodate cut-sheet media. It has been found, however, that cut sheet media tends to stall at a warm-pressure fixing nip. For example, in a fixing system having a hard fuser drum with a diameter of about 162 mm, a pressure roll with a diameter of about 70 mm diameter, and an applied nip pressure of about 500 psi to about 1000 psi, media tends to stall at the inlet of the nip, with respect to a process direction.

In apparatus in accordance with embodiments, a fixing device may include a first fixing member and a second fixing member. The first fixing member and the second fixing member define a fixing nip. In embodiments, at least one of the first fixing member and the second fixing member are movable to engage and/or disengage the first fixing member and the second fixing member, to define an engaged and disengaged fixing nip, respectively.

In embodiments of methods, a cut sheet processing method for warm-pressure fixing devices may include sensing a cut sheet approaching a fixing nip, the fixing nip being defined by a first fixing member and a second fixing member, at least one of the first fixing member and the second fixing member being movable for engaging and disengaging the first fixing member and the second fixing member. Methods may include disengaging the first fixing member and the second fixing member before the cut sheet enters the fixing nip; and engaging the first fixing member and the second fixing member, when the cut sheet enters the fixing nip. In embodiments, methods may include disengaging the fixing nip before the cut sheet exits the fixing nip.

In embodiments of systems, a cut sheet warm-pressure fixing system may include transporting a cut sheet using a cut sheet transport system that carries a cut sheet in a process direction. Systems may include sensing the cut sheet using a sensor, which may be located adjacent to the cut sheet transport system. Further, systems may include warm-pressure fixing a marking material image to the cut sheet at a fixing nip using a fixing device that disengages the fixing nip before the cut sheet enters the nip, and engages the fixing nip substantially when or after the cut sheet enters the fixing nip. Further, systems may include warm-pressure fixing using a fixing device that disengages before the cut sheet exits the engaged fixing nip.

Exemplary embodiments are described herein. It is envisioned, however, that any system that incorporates features of apparatus, methods and systems described herein are encompassed by the scope and spirit of the exemplary embodiments.

DRAWINGS

DETAILED DESCRIPTION

Figure 1:
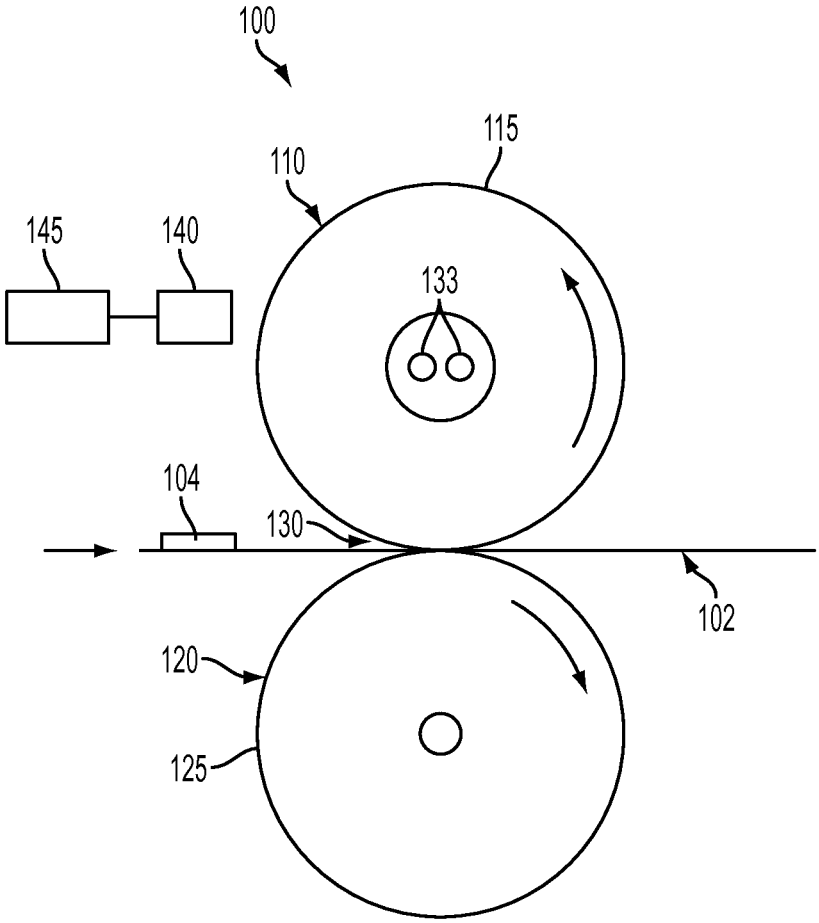
FIG. 1 shows a side diagrammatical view of a fixing device.

In a warm-pressure fixing system, a fixing device may include a first fixing member having a first surface and a second fixing member having a second surface, the first surface and the second surface defining a fixing nip at which warm-pressure fixing conditions are applied fix marking material to a substrate. A heat source may be implemented to heat at least one of the first surface and the second surface for applying heat at the fixing nip. The nip may be heated to a temperature below about 150° C., i.e., temperatures typical for thermal fixing. For example, the nip may be heated to a temperature of about 50° C. to about 120° C.

The first fixing member and the second fixing member are operable to apply pressure to the substrate and marking material at the fixing nip to fix the marking material to the substrate. Exemplary pressures to apply at the fixing nip for warm-pressure fixing are in a range of about 300 psi to about 3000 psi. For example, a warm-pressure fixing system may apply pressures of about 400 psi to about 1500 psi, and preferably about 500 psi to about 1000 psi at a fixing nip. Ranges may vary according to the type of marking material used. It has been found that media, particularly cut sheet media, tends to stall at the fixing nip when warm-pressure fixing conditions are applied.

Accordingly, printing apparatus and systems, which can encompass various types of apparatus that are used to form images on substrates with marking materials, may incorporate warm-pressure fixing systems in accordance with embodiments. These apparatus and systems may include printers, copy machines, facsimile machines, multi-function machines, and the like.

The use of relatively lower temperatures and moderate pressures can relax demands on the toner material composition and properties. Embodiments of the fixing system, printing apparatuses and methods can provide high image quality, a high level of printed image permanence, and reduced overall printing costs. In embodiments, by performing the toner fixing process as a multi-stage process, e.g., using a softening device for softening marking material prior to arrival at the fixing nip, at relatively lower temperatures, lower demands are placed on components of the fixing device, enabling application of robust, long-life components. These advantages, among others, may be realized for cut sheet media in addition to other media types using a fixing system with a fixing nip that engages and disengages in accordance with embodiments of apparatus, methods, and systems.

Reference is made to the drawings to accommodate understanding of apparatus, methods, and systems for fixing marking material to a substrate. In the drawings, like reference numerals are used throughout to designate similar or identical elements. The drawings depict various embodiments and data related to embodiments of illustrative methods, apparatus, and systems for warm-pressure fixing marking material to a substrate.

FIG. 1 shows an exemplary fixing device. Fixing device 100 is shown includes a first fixing member and a second fixing member, e.g., a fixing roll 110 and a pressure roll 115, which together define a fixing nip 130. The substrate 102 is fed through the fixing nip 130 at which the substrate 102 and marking material 104 may be subjected to heating, and may be subject to applied pressure by the fixing roll 110 and/or pressure roll 115. In other embodiments, the fixing device may have a construction including a belt configuration for one or more of the fixing members, such as a fixing belt that is entrained on one or more rolls and arranged in combination with the pressure roll 120 to form a fixing nip at which thermal energy and pressure may be applied to, e.g., a substrate and toner.

The fixing roll 110 may be internally and/or externally heated by a thermal energy source to a desired temperature. As shown, the thermal energy source may include internal heating elements 133, such as axially-extending lamps, located inside of the fixing roll 110 and powered to heat the outer surface 115 to the fixing temperature. A power supply 140 may be connected to the heating elements 133. The power supply 140 may be connected to a controller 145, which may be configured to control the supply of power to the heating elements 133. In other embodiments, the outer surface 115 may be externally heated by a thermal energy source by conduction, convection and/or radiation. For example, at least one external heating roll may be provided in contact with the outer surface 115.

In embodiments, the outer surface 115 of the fixing roll 110 may comprise of a metallic material, a ceramic material, or a composite material. For example, the fixing roll 110 may comprise an aluminum substrate that has been subjected to an anodizing process to convert the surface region of the substrate, including the outer surface 110, to porous anodized aluminum (aluminum oxide, $Al_2O_3$). The open pores of the anodized surface region can be impregnated with a suitable material to seal the open pores. For example, the open pores may be impregnated with a substance having lubricating properties, such as polytetrafluoroethylene (Teflon®), or the like, to seal the pores. The resulting outer surface 115 provides a desirable hardness and release properties.

Following the sealing process, the outer surface 115 may be polished to a smooth finish. To achieve uniform pressures at the fixing nip 130 along the axial length of the fixing roll 110 over the entire applied pressure range, the fixing roll 110 or the pressure roll 120 may be crowned.

In other embodiments, the fixing roll 110 may include one or more outer layers, each comprising a polymer or a polymer composite material. The outermost outer layer includes the outer surface 115. For example, the polymer can be polyurethane, nitrile butadiene rubber, or the like. Each outer layer may have a thickness of, e.g., about 1 mm to about 15 mm. It is desirable to minimize the thickness of the outer layer(s) to improve thermal conductivity and allow desirable fixing performance in the temperature range of about 50° C. to about 120° C. The outer layer(s) may contain one or more filler materials to increase thermal conductivity, improve durability and/or improve static charge buildup. The outer layer(s) may provide improved spreading of toner during the fixing process, and improved release performance by the fixing roll 110.

In the low-temperature, moderate-pressure regime in which the warm-pressure fixing device 100 can be operated, embodiments of the fixing roll 110 that include an outer surface 115 comprised of anodized aluminum, and embodiments that include one or more polymeric outer layers, provide resistance to the complex mechanical and chemical interactions that occur at the fixing nip 130 during fixing of toner to substrates.

In embodiments, the pressure roll 120 may comprise a core and a polymeric material overlying the core and forming the outer surface 125. For example, the polymeric material may be polyurethane, nitrile butadiene rubber, or the like. The polymeric material can be applied as a single layer, or as two or more layers. Different layers of the multi-layer constructions may have a different composition and properties from each other, e.g., a different elastic modulus. The pressure roll 120 may be heated.

In the warm-pressure fixing device 100, the outer surface 115 of the fixing roll 110 may be heated to a temperature that is suitable for warm-pressure fixing the toner formulation to the substrate 102. In embodiments, the temperature of the outer surface 115 (i.e., the fixing temperature) may be set to at least about 50° C., such as about 50° C. to about 120° C., about 70° C. to about 110° C., about 80° C. to about 110° C., or about 80° C. to about 100° C., for fixing the softened toner on the substrate 102. When the toner is softened by pre-heating, an even lower fixing temperature may be used in the fixing device 180 relative to embodiments in which the toner is softened without pre-heating at the softening device. The outer surface 115 may be operated at a fixing temperature that is close to the pre-heated temperature of the toner, e.g., less than about 10° C. higher, or less than about 5° C. higher, than the pre-heated temperature.

During fixing, the toner image is highly viscous. Moderate pressure is applied at the fixing nip 130 to ensure adequate adhesion to the substrate and good coalescence for permanence and high image quality. In embodiments, the amount of pressure applied to the substrate 102 at the fixing nip 130 may range from about 300 psi to about 3000 psi, such as about 300 psi to about 1500 psi, or about 400 psi to about 1000 psi. For warm-pressure fixing, increasing the fixing pressure at the fixing device 100 can allow a lower fixing temperature to be used.

In a printing apparatus, a pre-heating and/or heating temperature and a fixing temperature may be adjustable for different substrate materials and types. For a heavy-weight paper substrate 102 (coated or uncoated), the pre-heating temperature and/or the fixing temperature can be increased at a given dwell time, as compared to the pre-heating and fixing temperatures used for a light-weight paper substrate 102.

The temperature and pressure conditions used at a softening device and/or the fixing device 100 may be selected based on the melting temperature of the toner material used to form prints. For example, in an embodiment, the softening device may be operated at a pre-heating temperature of about 80° C. to about 90° C., and the fixing device 180 can be operated at a fixing temperature of about 80° C. to about 100° C. and a nip pressure of about 400 psi to about 700 psi to fix a first toner material to substrates. For a second toner material having a higher melting temperature than the first toner material, the softening device can be operated at a pre-heating temperature of about 90° C. to about 110° C., and the fixing device 100 can be operated at a fixing temperature of about 100° C. to about 110° C. and a nip pressure of about 400 psi to about 700 psi to fix the second toner material to substrates. In embodiments, the pre-heating temperature and the fixing temperature can be configured to melt the toner material at the fixing nip.

In embodiments of the fixing device 100, softening of toner combined with use of a relatively lower temperature at the fixing nip 130 may be further enabled through the use of low-melting and ultra-low-melting toner materials characterized as having a melting temperature that is altered (lowered) by heating the toner to a temperature above a threshold temperature and then re-heating the toner having the lowered melting temperature. Exemplary ultra-low-melting toners having these characteristics comprise a crystalline polymer material, such as crystalline polyester material, and an amorphous polymer material, such as amorphous polyester material, with the amorphous material having a glass transition temperature ($T_g$) separate from the melting temperature ($T_m$) of the crystalline material. In these toners, the crystalline polymer material imparts a low melting temperature to the toner. Exemplary toners having alterable melting temperature characteristics that may be used in the fixing device are disclosed in U.S. Pat. Nos. 7,402,371; 7,494,757 and 7,547,499, each of which is incorporated herein by reference in its entirety.

Toners having such temperature-alterable melting characteristics can be used in the fixing device 100 to further enhance the effectiveness of the pre-heating of the substrate 102 and toner in the fixing process. These toners can undergo a reduction in their melting temperature prior being fixed to the substrate 102 at the fixing nip 130 by being pre-heated using the softening device. As the substrate 102 is advanced to the fixing nip 130, additional thermal energy is applied to the substrate 102 and toner with the heated fixing roll 110.

Using a toner material having a low melting temperature, allows the process conditions of temperature (thermal energy input), pressure and/or dwell (print speed) to be lowered in the fixing nip 130 of the fixing device 110. Suitable toner materials may be expanded over other fusing approaches to provide optimal image quality, and low materials cost is enabled.

By operating at reduced toner temperatures in embodiments of the warm-pressure fixing systems, printing apparatus, and methods, improved system/substrate path robustness without toner blocking problems in output stacks can be achieved.

The operating set-points used in embodiments of the fixing systems and printing apparatuses accommodate low substrate temperatures. Therefore, substrate distortion issues that can occur at elevated process temperatures may be avoided. This feature can extend the substrate application space achieved with xerographic printing systems. For example, polymeric film materials used in packaging may be used as the substrate in the fixing systems and printing apparatuses. The use of low operating temperatures also reduces or avoids water evaporation and reabsorption by paper and, consequently, can minimize or eliminate this potential source for paper distortion.

Systems, apparatus, and methods of embodiments also enhance images post-fixing processing. For example, related thermal fusers operate at very high temperatures, e.g., 150° C. to about 210° C. The toner, after fixing and prior to cooling, is vulnerable to offsetting to an adjacent surface, taking on the surface of whatever it comes into contact with, and differentially cooling by way of contact. Image quality suffers as a result. Ultra-low melting toners tend to increase the potential for image artifacts. Warm-pressure fixing addresses these issues. These advantages may be realized for cut sheet media by using a fixing device having at least one of a first fixing member and a second fixing member that is movable for engaging and disengaging a fixing nip, in accordance with embodiments.

Figure 2:
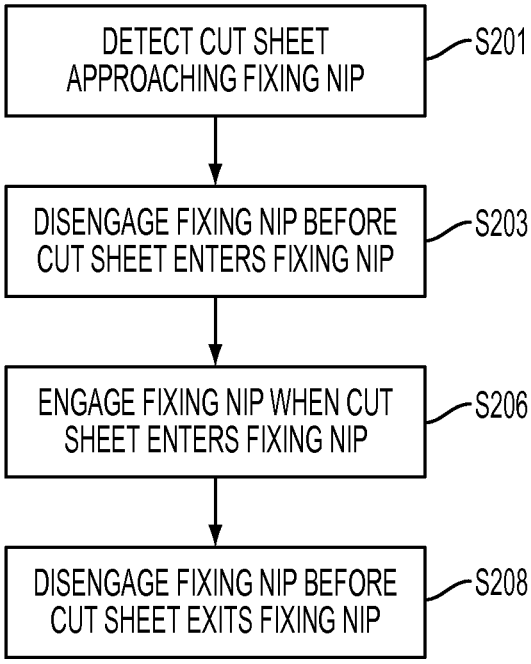
FIG. 2 shows a flow diagram of a cut sheet warm-pressure fixing process in accordance with embodiments.

FIG. 2 shows a process diagram of a method in accordance with embodiments. For example, as shown in FIG. 2, methods for disengaging and engaging a fixing nip may include a step S201 of detecting a cut sheet that is approaching the fixing nip. For example, a sensor may be placed near or adjacent to a cut sheet transport system for sensing a transported cut sheet. The cut sheet transport system passes through the fixing nip. The sensor may sense a cut sheet, and generate and transmit a signal to a controller for processing. In embodiments, the sensor may be used to determine a location of the cut sheet, e.g., with respect to a location of the fixing nip.

In embodiments, one or more sensors may be used to detect a lead edge of a cut sheet, and/or a trail edge of a cut sheet. For example, the sensor may be used to determine a location of a lead edge of a cut sheet. The sensor may also be used to sense a location of a trail edge of a cut sheet. In alternative embodiments, a thickness of a cut sheet approaching a fixing nip may be determined by sensing a cut sheet approaching a fixing nip. In further alternative embodiments, a time of nip entry and nip exit by portions of a cut sheet may be determined. One or more of the aforementioned sensing techniques, among others, may be implemented for accommodating sensing of a cut sheet for processing by a fixing nip.

At least one of the first fixing member and the second fixing member may be configured to move to accommodate engaging and disengaging of the fixing nip. In the embodiment of FIG. 2, step S203 may include disengaging the fixing nip before the sensed cut sheet enters the fixing nip. For example, prior to disengaging the fixing nip in S203, a first fixing member and a second fixing member, which together define a fixing nip, may be in an engaged position, whereby an engaged fixing nip is defined. Based on a determination that a cut sheet is approaching, by way of, e.g., S201, the fixing nip may be disengaged in S203 to accommodate nip entry of the sensed cut sheet. For example, in S203, the fixing nip may be disengaged to accommodate entry of a lead edge of a cut sheet having an image thereon to be fixed by warm-pressure fixing.

After the cut sheet enters the fixing nip, the first fixing member and the second fixing member are in a disengaged position to define a disengaged fixing nip. In S206, the fixing nip may be engaged, and the cut sheet subject to warm-pressure fixing in the engaged fixing nip. In some embodiments, including the embodiment shown in FIG. 2, the fixing nip may be disengaged in a step S208 to accommodate exit of the cut sheet after warm-pressure fixing at the engaged fixing nip. For example, the engaged fixing nip maybe disengaged in a step S208 before the cut sheet exits the fixing nip. In an embodiment, the fixing nip may be disengaged in a step S208 before a trail edge of the cut sheet exits the fixing nip.

Any one or more of the steps shown in FIG. 2 may be repeated for warm-pressure fixing a plurality of cut sheets. For example, a plurality of cut sheets may be warm-pressure fixed at speed with the exemplary methods of embodiments shown in FIG. 2. Apparatus, methods, and systems of embodiments may accommodate, for example, high volume cut sheet printing at 100 to 200 prints per minute wherein images are warm-pressure fixed to the cut sheets.

Figure 3:
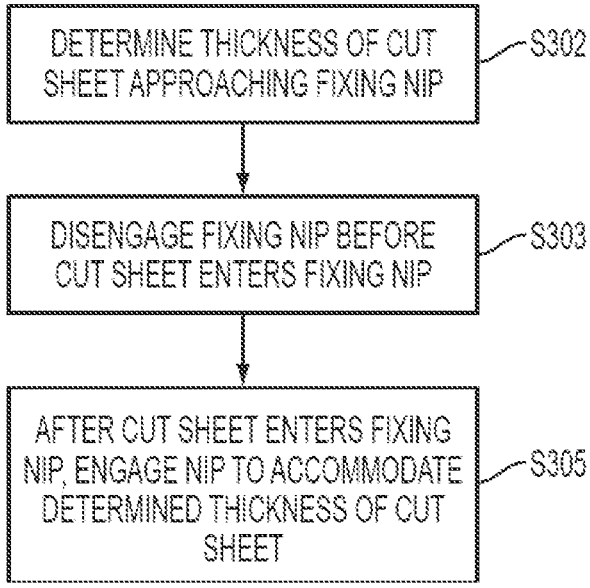
FIG. 3 shows a flow diagram of a cut sheet warm-pressure fixing process in accordance with embodiments.

FIG. 3 shows another exemplary embodiment of methods. For example, methods of embodiments as shown in FIG. 3 may include a S302 of determining a thickness of a cut sheet approaching a fixing nip. Before step S303, the fixing nip may be in an engaged position. In step S303, the fixing nip may be disengaged before the cut sheet enters the fixing nip. After the cut sheet enters the fixing nip, the fixing nip may be engaged in step S305 to accommodate the cut sheet having the determined thickness. For example, after a lead edge of a cut sheet enters the fixing nip, the fixing nip may be engaged. The degree to which the fixing nip is engaged may be configured to depend on the determined thickness of the cut sheet. In S305, the fixing nip is engaged insofar as the nip accommodates effective warm-pressure fixing of the cut sheet having the determined thickness.

In embodiments, as shown in FIG. 3, one or more steps may be repeated for a plurality of cut sheets. For example, the fixing nip may be engaged to a degree that accommodates a thickness of a first sensed cut sheet having a first thickness, but does not accommodate a subsequent second sensed cut sheet having a second thickness. Accordingly, in embodiments, S302-S305 may be executed for a first cut sheet, and S302-S305 may be repeated for subsequent cut sheets. A new thickness for each subsequent cut sheet may be determined in S302, which may be used for engaging the fixing nip in S305 to a degree that is suitable for each subsequent cut sheet, even if each subsequent cut sheet varies in thickness from one another. Accordingly, methods of embodiments accommodate at speed volume printing of cut sheets having different thicknesses.

Figure 4:
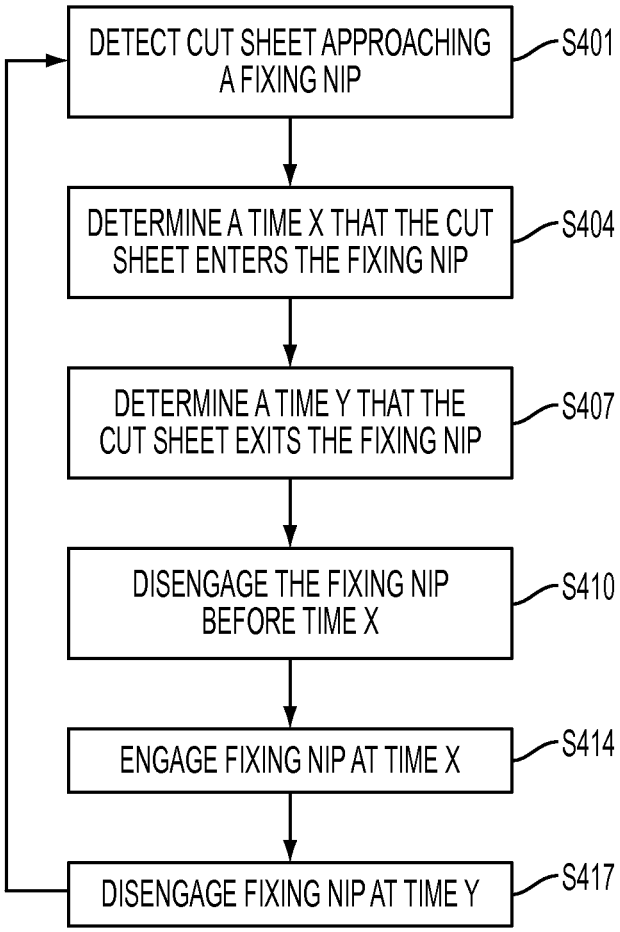
FIG. 4 shows a flow diagram of a cut sheet warm-pressure fixing process in accordance with embodiments.

FIG. 4 shows a process diagram of methods in accordance with embodiments. For example, as shown in FIG. 4, methods for disengaging and engaging a pressure nip for warm-pressure fixing may include a step S401 of detecting a cut sheet that is approaching a fixing nip. For example, a sensor may be placed near or adjacent to a cut sheet transport system for sensing a transported cut sheet. The cut sheet transport system passes through the fixing nip. The sensor may, e.g., sense a cut sheet, and generate and transmit a signal to a controller for processing. In embodiments, the sensor may be used to determine a location of the cut sheet, e.g., with respect to a location of the fixing nip.

In embodiments, one or more sensors may be used to detect a lead edge of a cut sheet, and/or a trail edge of a cut sheet. The sensor may be used to determine a location of a lead edge of a cut sheet. The sensor may also be used to sense a location of a trail edge of a cut sheet. In alternative embodiments, a thickness of a cut sheet approaching a fixing nip may be determined by sensing a cut sheet approaching a fixing nip. In further alternative embodiments, a time of nip entry and nip exit by portions of a cut sheet may be determined. One or more of the aforementioned sensing techniques, among others, may be implemented for accommodating sensing of a cut sheet for processing by a fixing nip.

At least one of the first fixing member and the second fixing member may be configured to move to accommodate engaging and disengaging of the fixing nip. In some embodiments, this may be accomplished by determining a time that a cut sheet enters and/or exits a warm-pressure fixing nip. In the embodiment of FIG. 4, step S404 may include determining a time x that the cut sheet enters the fixing nip. For example, by way of, e.g., S401, methods may include determining a location of the cut sheet with respect to the fixing nip, and, e.g., a speed that the cut sheet is transported on the cut sheet transport. Embodiments may include, determining a time y that the cut sheet exits the fixing nip, as shown in S407.

Methods in accordance with embodiments as shown in FIG. 4 may include disengaging the fixing nip before the sensed cut sheet enters the fixing nip. For example, prior to disengaging the fixing nip in S410, a first fixing member and a second fixing member, which together define a fixing nip, may be in an engaged position, whereby an engaged fixing nip is defined. Based on a determination that a cut sheet is approaching, by way of, e.g., S401, the fixing nip may be disengaged in S410 to accommodate entry of the sensed cut sheet. For example, in S410, the fixing nip may be disengaged to accommodate entry of a lead edge of a cut sheet having an image thereon to be fixed by warm-pressure fixing. In embodiments, the time that the cut sheet enters the nip may be determined in S404 as time x. S410 may be implemented to disengage the fixing nip substantially at or before time x.

After the cut sheet enters the fixing nip, the first fixing member and the second fixing member are in a disengaged position to define a disengaged fixing nip. In S414, the fixing nip may be engaged, and the sensed cut sheet subject to warm-pressure fixing in the engaged fixing nip.

In some embodiments, including the embodiment shown in FIG. 4, the fixing nip may be disengaged in S417 to accommodate exit of the cut sheet after warm-pressure fixing at the engaged fixing nip. For example, the engaged fixing nip maybe disengaged in a step S417 before the cut sheet exits the fixing nip. In an embodiment, the fixing nip may be disengaged in a step S417 before a trail edge of the warm-pressure fixed cut sheet exits the fixing nip. Any one or more of the steps shown in FIG. 4 may be repeated for warm-pressure fixing a plurality of cut sheets. For example, a plurality of cut sheets may be warm-pressure fixed at speed with apparatus, methods, and systems of embodiments.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A warm-pressure fixing device, comprising:

a first fixing member;

a second fixing member, the first fixing member and the second fixing member defining a fixing nip, and at least one of the first fixing member and the second fixing member being movable to engage and disengage the first fixing member and the second fixing member;

a controller that controls the movement of the at least one of the first mixing member and the second fixing member; and a sensor configured to sense a cut sheet on a transport pathway, the cut sheet transport pathway extending through the fixing nip, wherein the controller controls the movement of the at least one of the first fixing member and the second fixing member such that the first fixing member and the second fixing member are in a disengaged position when a lead edge of the cut sheet enters the fixing nip and such that the at least one of the first fixing member and the second fixing member is moved into an engaged position after the lead edge has passed the fixing nip and while the cut sheet is in the fixing nip.

2. The fixing device of claim 1, wherein the sensor is configured to sense at least one of the lead edge and a trail edge of the cut sheet.

3. The fixing device of claim 1, wherein the sensor is configured to sense the lead edge of the cut sheet approaching the fixing nip on the cut sheet transport pathway.

4. The fixing device of claim 1, wherein the sensor is configured to sense a cut sheet thickness of the cut sheet approaching the fixing nip on the cut sheet transport pathway.

5. The fixing device of claim 4, wherein the first fixing member and the second fixing member are engaged to accommodate the sensed sheet thickness of the cut sheet.

6. The fixing device of claim 1, wherein the first fixing member and the second fixing member are engaged, the fixing nip being engaged, after a first portion of the cut sheet enters the fixing nip.

7. The fixing device of claim 6, wherein the first fixing member and the second fixing member are disengaged before a second portion of the cut sheet exits the fixing nip.

8. The fixing device of claim 1, wherein the first fixing member and the second fixing member are disengaged, the fixing nip being disengaged, before the cut sheet exits the fixing nip.

9. A cut sheet processing method for warm-pressure fixing devices, comprising:

sensing a cut sheet approaching a fixing nip, the fixing nip being defined by a first fixing member and a second fixing member, at least one of the first fixing member and the second fixing member being movable for engaging and disengaging the first fixing member and the second fixing member;

disengaging the first fixing member and the second fixing member before the cut sheet enters the fixing nip; and moving the at least one of the first fixing member and the second fixing member into an engaged position whereby the fixing nip is engaged after a lead edge of the cut sheet enters the fixing nip and while the cut sheet is in the fixing nip.

10. The cut sheet processing method of claim 9, further comprising:

disengaging the first fixing member and the second fixing member before the cut sheet exits the engaged fixing nip.

11. The cut sheet processing method of claim 10, further comprising:

determining a cut sheet nip exit time, wherein the first fixing member and the second are disengaged before the cut sheet nip exit time.

12. The cut sheet processing method of claim 11, wherein the cut sheet nip exit time is a time at which a trail edge of the cut sheet exits the fixing nip.

13. The cut sheet processing method of claim 9, further comprising:

determining a thickness of the cut sheet, wherein the engaged fixing nip accommodates the determined cut sheet thickness.

14. The cut sheet processing method of claim 9, further comprising:

determining a cut sheet nip entrance time, wherein the first fixing member and the second fixing member are engaged after the determined cut sheet nip entrance time.

15. The cut sheet processing method of claim 14, wherein the first fixing member and the second fixing member are disengaged before the determined cut sheet nip entrance time.

16. The cut sheet processing method of claim 14, wherein the cut sheet nip entrance time is a time at which the lead edge of the cut sheet enters the fixing nip.

17. A cut sheet warm-pressure fixing method, comprising:

transporting a cut sheet using a cut sheet transport system that carries a cut sheet in a process direction;

sensing the cut sheet using a sensor; and warm-pressure fixing a marking material image to the cut sheet at a fixing nip using a fixing device that disengages the fixing nip before the cut sheet enters the nip, engages the fixing nip after the cut sheet enters the fixing nip and while the cut sheet is in the fixing nip, and disengages the fixing nip before the cut sheet exits the fixing nip.

* * * * *